US006189346B1

(12) United States Patent
Chen et al.

(10) Patent No.: US 6,189,346 B1
(45) Date of Patent: Feb. 20, 2001

(54) CLOTHES TREATING APPARATUS

(75) Inventors: David H. Chen, St. Joseph, MI (US); David Blakely, Mt. Veiw, CA (US); Bruce MacGregor, Palo Alto, CA (US); Rudy Lucas Samuels, San Francisco, CA (US); Reynaldo Jose Quintana, Menlo Park, CA (US)

(73) Assignee: Whirlpool Corporation, Benton Harbor, MI (US)

( * ) Notice: Under 35 U.S.C. 154(b), the term of this patent shall be extended for 0 days.

(21) Appl. No.: 09/286,075

(22) Filed: Apr. 5, 1999

Related U.S. Application Data

(60) Provisional application No. 60/083,187, filed on Jul. 25, 1997.

(51) Int. Cl.[7] ..... D06B 1/02
(52) U.S. Cl. ..... 68/5; 68/205 R
(58) Field of Search ..... 68/5 C, 6, 205 R; 34/621, 622; 223/67, 70; 38/1 A, 3, 14

(56) References Cited

U.S. PATENT DOCUMENTS

| | | | | |
|---|---|---|---|---|
| 1,948,568 | * | 2/1934 | Faber et al. | 68/5 C X |
| 2,741,113 | * | 4/1956 | Norkus | 68/205 R |
| 2,746,802 | | 5/1956 | Feis | 299/140 |
| 2,767,568 | * | 10/1956 | Pope | 68/5 C |
| 3,114,919 | * | 12/1963 | Kenreich | 68/205 R X |
| 3,166,923 | | 1/1965 | Zacks | 68/5 |
| 3,513,869 | * | 5/1970 | Nirenberg | 68/5 C |
| 3,709,433 | | 1/1973 | Obergefell et al. | 239/8 |
| 3,876,150 | | 4/1975 | Dwyer, Jr. et al. | 239/424 |
| 4,004,733 | | 1/1977 | Law | 239/3 |
| 4,096,714 | | 6/1978 | Nirenberg | 68/5 |
| 4,180,919 | | 1/1980 | Baltes | 34/23 |
| 4,761,305 | * | 8/1988 | Ochiai | 68/5 C X |
| 5,188,291 | | 2/1993 | Cross | 239/3 |
| 5,341,991 | | 8/1994 | Ericsson | 239/8 |
| 5,513,798 | | 5/1996 | Taylor | 239/8 |
| 5,520,331 | | 5/1996 | Wolfe | 239/8 |
| 5,595,071 | | 1/1997 | Pasad et al. | 68/5 C |
| 5,600,975 | * | 2/1997 | McClain et al. | 68/5 C |

FOREIGN PATENT DOCUMENTS

| | | | |
|---|---|---|---|
| 816552A2 | 6/1997 | (EP) | D06F/73/02 |

OTHER PUBLICATIONS

European Search Report Eo 99 10 7858 dated Dec. 16, 1999.

* cited by examiner

*Primary Examiner*—Philip R. Coe
(74) *Attorney, Agent, or Firm*—Joel M. Van Winkle; Thomas J. Roth; Robert O. Rice

(57) ABSTRACT

A clothes treating apparatus including a cabinet defining an interior region in which a garment can be hung. A door is movably connected to the cabinet for closing the interior region. A fluid atomizing nozzle is supported by the cabinet and is fluidly connected to a reservoir containing a conditioning composition. An air compressor is connected to the nozzle for supplying air to the nozzle such that when the air compressor is energized the conditioning composition is drawn out of the reservoir and sprayed from the nozzle in a mist form into the interior region. A fan is provided for circulating air within the interior region such that the mist form of the conditioning composition is uniformly distributed onto the garment hanging within the interior region. Accordingly, the clothes treating apparatus provides a means for applying a conditioning composition onto garments which does not include means for supplying steam into the interior region. The present invention may include an inflatable hanger bag assembly wherein the garment can be disposed about the inflatable bag. A blower supported by the cabinet is provided for inflating the inflatable bag to press the garment against opposed inner side surfaces of the interior region during or subsequent to the application of conditioning composition to the garment. In this manner the garment may be pressed in order to remove wrinkles.

9 Claims, 3 Drawing Sheets

CLOTHES TREATING APPARATUS

This application claims the benefit of U.S. Provisional Application No. 60/083,187 filed Jul. 25, 1997.

BACKGROUND OF THE INVENTION

The present invention relates to a garment treating apparatus and more particularly to an apparatus for cleaning, deodorizing and dewrinkling garments as a result of being subjected to a conditioning composition in a controlled manner substantially without the application of steam.

The prior art reflects efforts to develop garment treating systems for home use which clean, remove wrinkles and refresh garments or clothes items which are preferably not washed using conventional full water immersion wash processes. The problem has been to develop a high performing, cost effective home system for cleaning and refreshing garments which are delicate, subject to shrinkage or require a wrinkle free appearance. Such garments are typically cleaned using commercial laundry or dry cleaning services. Past efforts have focused on clothes treating cabinets designed to clean and refresh garments by employing a combination of steam and hot air which is applied to the garments.

For example, U.S. Pat. No. 3,752,373 discloses a cabinet comprising a housing of flexible material which defines an interior region for hanging clothes. A steam generator is mounted in the lower region of the housing to steam the clothes. A fan and heating element are also provided in the lower portion of the housing for delivering heated air into the interior region for drying and airing the clothes.

Another example of a clothes steaming cabinet is found in U.S. Pat. No. 5,305,484. This patent discloses a cabinet for receiving clothes having a steam delivery means and a hot air delivery means. The appliance includes a steaming cycle and a drying cycle. Hangers and a bar are provided for suspending clothes items and weighted bars are provided to tension the clothes such that wrinkles are removed.

Both of the above described systems rely primarily on steam for supplying moisture to the clothes in an attempt to remove wrinkles and refresh the clothes items. Unfortunately, the use of steam consumes a relatively large amount of energy in heating water and also adds to the drying time. More importantly, steam is relatively unable to carry finishing agents or conditioning compositions which are preferably deposited on the garments for cleaning, dewrinkling and deodorizing purposes.

U.S. Pat. No. 4,761,305 discloses a method of finishing garments by hanging them in a sealed chamber, spraying a finishing agent which imparts refreshing and cleaning benefits, and thereafter or simultaneously therewith, fully applying steam to the garments. In a final step, hot air is blown through the sealed chamber to dry the garments. This system has the benefit of providing a means for supplying a finishing agent to hanging clothes items but has the drawback of requiring the addition of steam to impart the desired benefits.

Accordingly, despite numerous disclosures in the prior art, there remains a need for a process for satisfactorily conditioning garments which is convenient for home use. There is also a need for such a process that has improved cost and time effectiveness in that steam applications are not required.

SUMMARY OF THE INVENTION

According to the present invention, the foregoing and other needs in the art are attained by a clothes treating apparatus including a cabinet defining an interior region. A rod or hook extends from an inner wall of the cabinet for supporting at least one hanger on which a garment can be hung within the interior region. A door is movably connected to the cabinet for closing the interior region. A fluid atomizing nozzle is supported by the cabinet and is fluidly connected to a reservoir containing a conditioning composition. An air compressor is connected to the nozzle for supplying air to the nozzle such that when the air compressor is energized the conditioning composition is drawn out of the reservoir and sprayed from the nozzle in a mist form into the interior region. A fan is provided for circulating air within the interior region such that the mist form of the conditioning composition is uniformly distributed onto the garment hanging within the interior region. Accordingly, the clothes treating apparatus provides a means for applying a conditioning composition onto garments which does not include means for supplying steam into the interior region.

The nozzle operates to mix compressed air and the conditioning composition and spray atomized conditioning composition into the interior region. Specifically, the nozzle includes an air passage and a fluid passage. The reservoir is supported by the cabinet below the nozzle and is fluidly connected to the fluid passage within the nozzle. The air compressor is connected to the air passage of the nozzle for supplying air to the nozzle such that an air stream flows over a fluid outlet and automatically draws conditioning composition from the reservoir such that conditioning composition is mixed with the air flow for forming a mist which is dispensed from the nozzle without requiring a valve between the reservoir and nozzle.

The present invention may include an inflatable bag associated with the hanger wherein the garment can be disposed about the inflatable bag. A blower supported by the cabinet is provided for inflating the inflatable bag to press the garment against opposed inner side surfaces of the interior region during or subsequent to the application of conditioning composition to the garment. In this manner the garment may be pressed in order to remove wrinkles.

DETAILED DESCRIPTION OF THE PREFERRED EMBODIMENTS OF THE INVENTION

Figure 1:
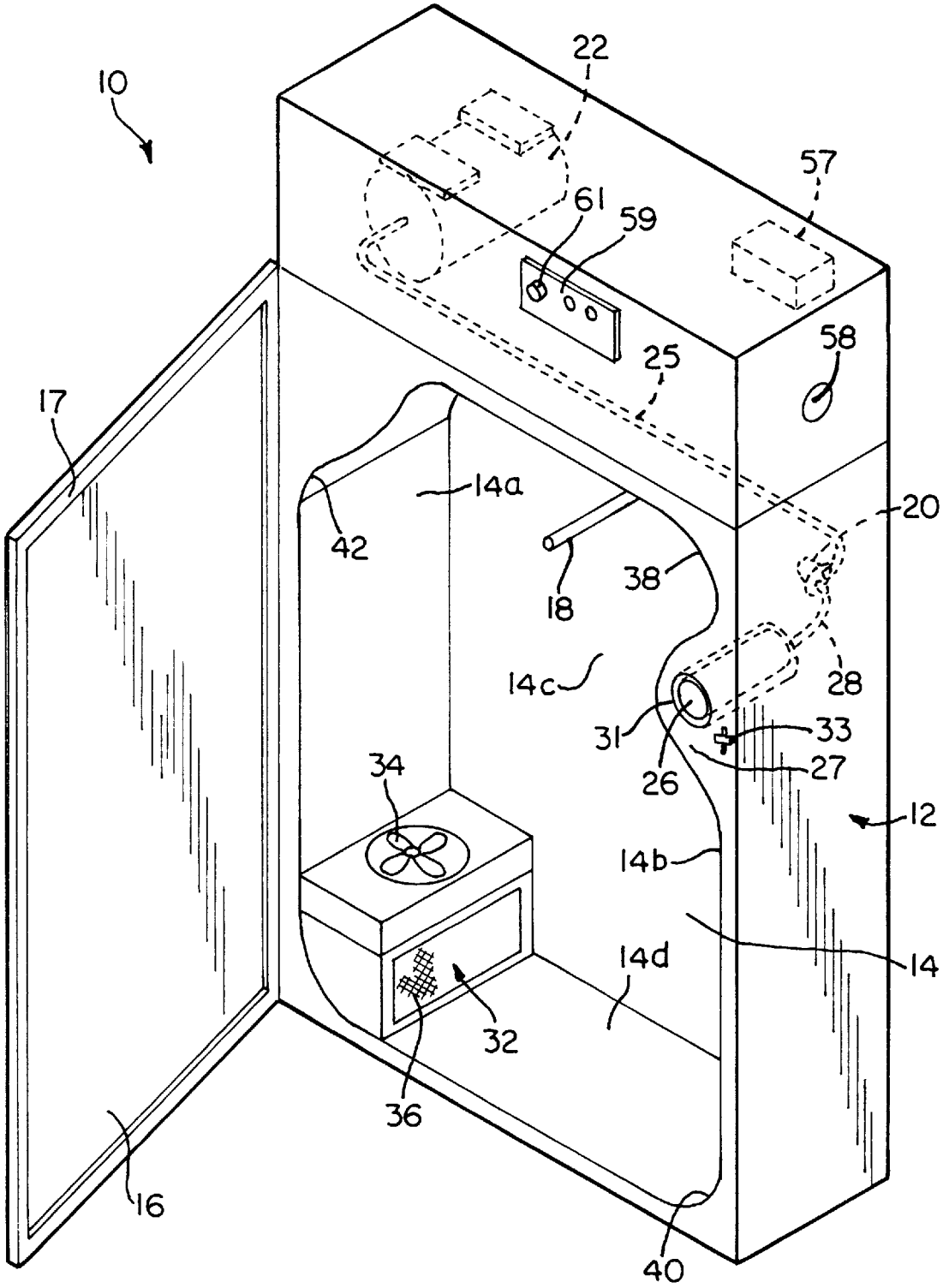
FIG. 1 is a top, front perspective view of the clothes treating cabinet apparatus of the present invention with the door open.

Referring to FIG. 1, there is illustrated a clothes treating apparatus for refreshing garments according to the present invention. As used herein, the term "refreshing" means cleaning, dewrinkling, and/or deodorizing garments. The apparatus 10 includes a main housing or cabinet 12. The cabinet 12 forms an interior region 14 having opposite side walls 14*a* and 14*b*, a top wall 14*c*, a bottom wall 14*d* and a rear wall 14*e*. A door 16 is hingedly connected to the cabinet 12 for closing the interior region 14 formed by the cabinet 12. The door 16 includes an inner surface 16*a* wherein when the door 16 is closed, the rear wall 14*e* of the cabinet 12 and inner surface 16*a* of the door 16 form opposed inner side surfaces of the interior region. A gasket 17 is provided disposed about the periphery of the door 16 for sealing the interface between the door 16 and cabinet 12.

Garments are hung within the interior region 14 from a rod 18 extending from the rear wall 14*e* of the interior region 14. A mist of conditioning composition is sprayed into the interior region 14 through a fluid atomizing nozzle 20 (FIG. 2), mounted onto the side wall 14*b*. As described herein below, the present invention is configured such that the conditioning composition is uniformly applied to the hanging garments for refreshing the garments. As used herein, the term mist means atomized droplets of fluid which may contain solid particles in solution with the fluid.

Effective distribution of the conditioning composition is important to achieving the desired conditioning benefits and is enhanced by selecting a mist form of the conditioning composition in which the mean particulate diameter size is optimally chosen. To that end, the mean particular diameter size of the conditioning composition mist is preferably from about 3 microns to about 50 microns, more preferably from about 5 microns to about 30 microns, and most preferably from about 10 microns to about 20 microns. Furthermore, it is preferable for the particular diameter size to having narrow particle size distribution to enhance the distribution of the conditioning composition further.

For purposes of enhancing the effective distribution of the conditioning composition on the garments, the misting of the conditioning composition can be achieved using any suitable spraying device such as a hydraulic nozzle, sonic nebulizer, high pressure fog nozzle or the like to deliver target particle sizes. However, the misting is preferably accomplished using a relatively low volume air atomization nozzle. For example, spray nozzles commercially available from Spray Systems, Inc. (Model Nos. 850, 1050, 1250, 1450 and 1650) are suitable.

Figure 2:
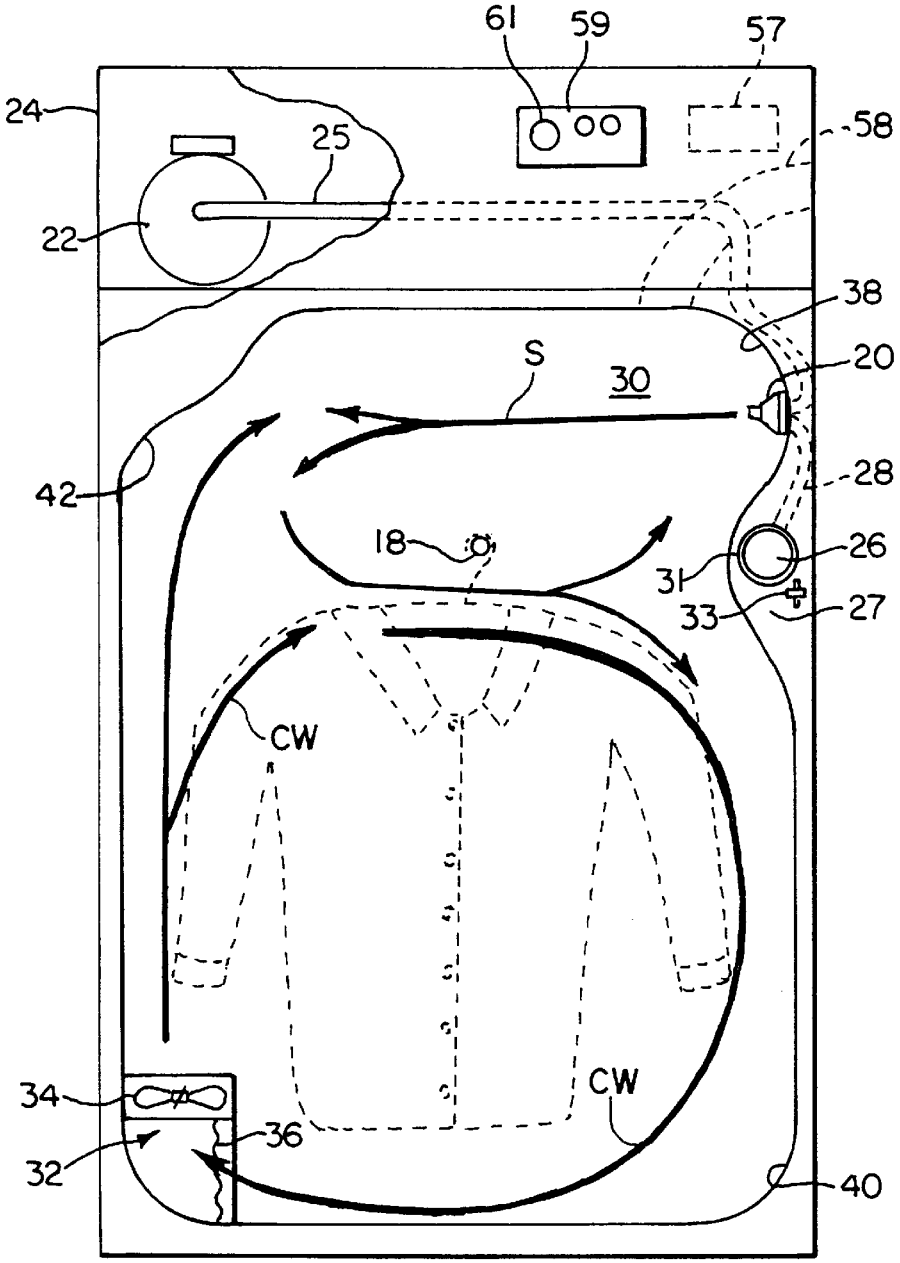
FIG. 2 is a schematic illustration of the flow of air and mist form of conditioning composition within the clothes treating cabinet of FIG. 1.

To achieve the misting of the conditioning composition within the interior region 14, a compressor 22 is provided which may preferably be supported in an upper housing 24 of the cabinet 12. The compressor 22 is connected to an air supply tube 25 which supplies air to the nozzle 20 (FIG. 2). Alternatively, the compressor 22 may be housed in a base of the cabinet 12 with a supply tube extending upwardly to the nozzle 20.

The conditioning composition is supplied to the nozzle 20 from a reservoir container 26 which is removably supported within a 31 cavity formed into a baffle section 27 of the side wall 14*b* of the cabinet. The reservoir 26 is a generally cylindrical, bottle-like container and is releasably connected to a fluid supply tube 28 which extends upwardly to the nozzle 20. Accordingly, the reservoir 26 is readily filled with conditioning composition by removing it from the side wall cavity and adding conditioning composition. A release lever 33 may be provided which when depressed by the user causes the container 26 to be disconnected from the fluid supply tube 28 and partially ejected from the cavity 31. During misting periods, the air compressor is operated and conditioning composition is drawn up into the nozzle and sprayed into the interior region 14. The reservoir may be provided with a relief valve to prevent an undesirable vacuum condition from forming within the reservoir 26.

As shown in FIG. 2, the clothes treating 10 is configured to promote effective application of a conditioning composition onto garments hanging within the interior region 14. To that end, the nozzle 20 is mounted to the side wall 14*b* near the top of the interior region 14 above the baffle section 27. The rod 18 is located below the top wall 14*c* such that the garments hang within the interior region 14 below the nozzle 20. The conditioning composition is sprayed, as indicated by the arrows labeled S, into the open area of the interior region between the top wall 14*c* and the hanging garments, referred to herein as a deceleration region 30. Within the unobstructed deceleration region 30, the mist sprayed from the nozzle 20 is given an opportunity to decelerate such that the mist is allowed to circulate gently within the interior region 14 and uniformly distribute itself onto the hanging garments. In this regard, the deceleration region 30 is preferably 1.736 cu. ft. (10"×10"×30") or more of "dead" space, such that the spray has an adequate region to decelerate.

To provide for heating and moving air within the cabinet 12, a recirculation fan assembly 32 is provided within the lower portion of the interior region 14. The fan assembly 32 includes a fan 34 and a heater 36. The fan 34 is positioned to move air within the interior region 14 in a general clockwise direction, indicated by the arrows labeled CW. As can be seen, the movement of air within the cabinet 12 is opposed to the spray S of conditioning composition into the interior region 14. Accordingly, the recirculation of air acts to further decelerate the spray of conditioning composition.

Even and smooth air flow within the cabinet 12 is promoted by providing the interior region 14 with rounded corners 38, 40 and 42. Additionally, the baffle section 27 of the side wall 14*b* acts to promote recirculation of air within the lower portion of the interior region 14 below the deceleration region 30.

Figure 3:
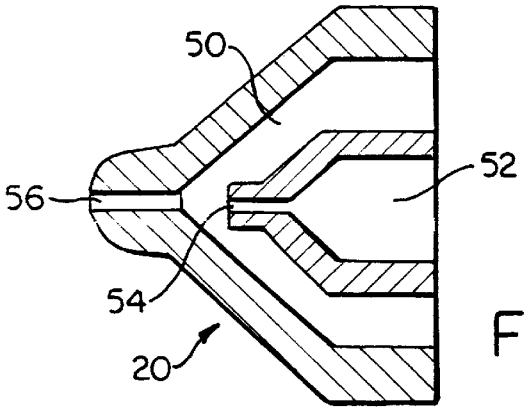
FIG. 3 is an illustration of the nozzle used to spray conditioning composition into the cabinet of FIG. 1.

As discussed above, the liquid conditioning composition is dispensed into the interior region 14 as a mist by combining it with an air stream under pressure and passing it through the atomization nozzle 20. FIG. 3 provides a general illustration of the configuration of the nozzle 20. As shown, the air from the compressor 22 is supplied to an annular, conically shaped air passage 50 of the nozzle 20. Preferably, the air provided from the compressor 22 has a pressure of from about 5 psi to about 30 psi. Optionally, the temperature of the air supplied from the compressor 22 can be heated to enhance distribution and deposition of the conditioning composition onto the hanging garments. The fluid supply tube 28 of the reservoir 26 is connected to a fluid passage 52 centrally disposed within the air passage 50. Air flowing through the air passage 50 passes over an outlet orifice 54 of the fluid passage 52. The flow of air past the outlet orifice 54 creates a low pressure region that draws the liquid out of the reservoir 26. After being drawn through the outlet orifice 54, the conditioning composition is mixed with air and sprayed out though a nozzle outlet 56.

While not intending to be bound by theory, it is believed that the conditioning composition comes from the orifice 54 in fine strands. The surface tension of the conditioning composition and the shearing forces from impact with the nozzle outlet 56 break up the fine strands into smaller droplets. These droplets are carried away from the nozzle 20 by their initial momentum and the flow of air exiting the nozzle outlet 56.

A controller 57 and control panel 59 (FIG. 2) is provided for operating the compressor 22 and fan assembly 32 in accordance with the cycle selected by the user of the clothes treating apparatus 10. The control panel may include a cycle selection knob 61 allowing the user to select a cycle that matches the type of clothes to be treated such as cotton, wool or delicate. The process for refreshing the garments hung within the apparatus 10 preferably includes a first period of applying the conditioning composition in a mist form onto the garments. The time for applying the conditioning composition may be between 10 and 30 minutes depending on the choice of cycle and the load size. While the conditioning composition is being supplied into the interior region 14, the fan 34 is energized to circulate air within the cabinet 12. Optionally, the heater 36 may be periodically energized for supplying heat to the distributed conditioning composition.

Following the application of the condition composition, the heater 36 and fan 34 are energized such that warm air is recirculated over the garments hanging within the cabinet and the conditioning composition applied to the garments is dried. Preferably, the temperature of air during the drying period is in the range from 40° C. to about 80° C., more preferably from about 50° C. to about 65° C. The drying time period may be from 10 to 180 minutes long, depending on the cycle selected and load size. An exhaust air duct 58, shown in FIG. 2, may be provided for allowing air to be exhausted from the interior region 14 during the drying period. The exhaust duct 58 may be connected with duct work such that the exhaust air is vented out of the user's home as is conventional in dryer applications. The duct may be provided with a closing means such that the duct can be closed during the conditioning composition application step.

The particular conditioning composition selected for use in the process can vary widely depending upon the particular benefit desired. However, in preferable modes of operating the conditioning composition will contain ingredients which can be effective across a variety of garment fabrics. For example, the conditioning composition will preferably be suitable for "dry-clean" only garments as well as pure cotton dress shirts which typically require a significant de-wrinkling operating subsequent to conventional laundering operations (i.e. home washings and drying cycles). By way of example, one suitable composition which provides refreshing benefits comprises, by weight; from about 0.001% to about 10% of a diethylene glycol; from about 0.01% to about 10% of a beta cylcodextrin; from about 0.001% to about 5% of a surfactant; from about 0% to about 2% of a preservative; and the balance water.

Figure 4:
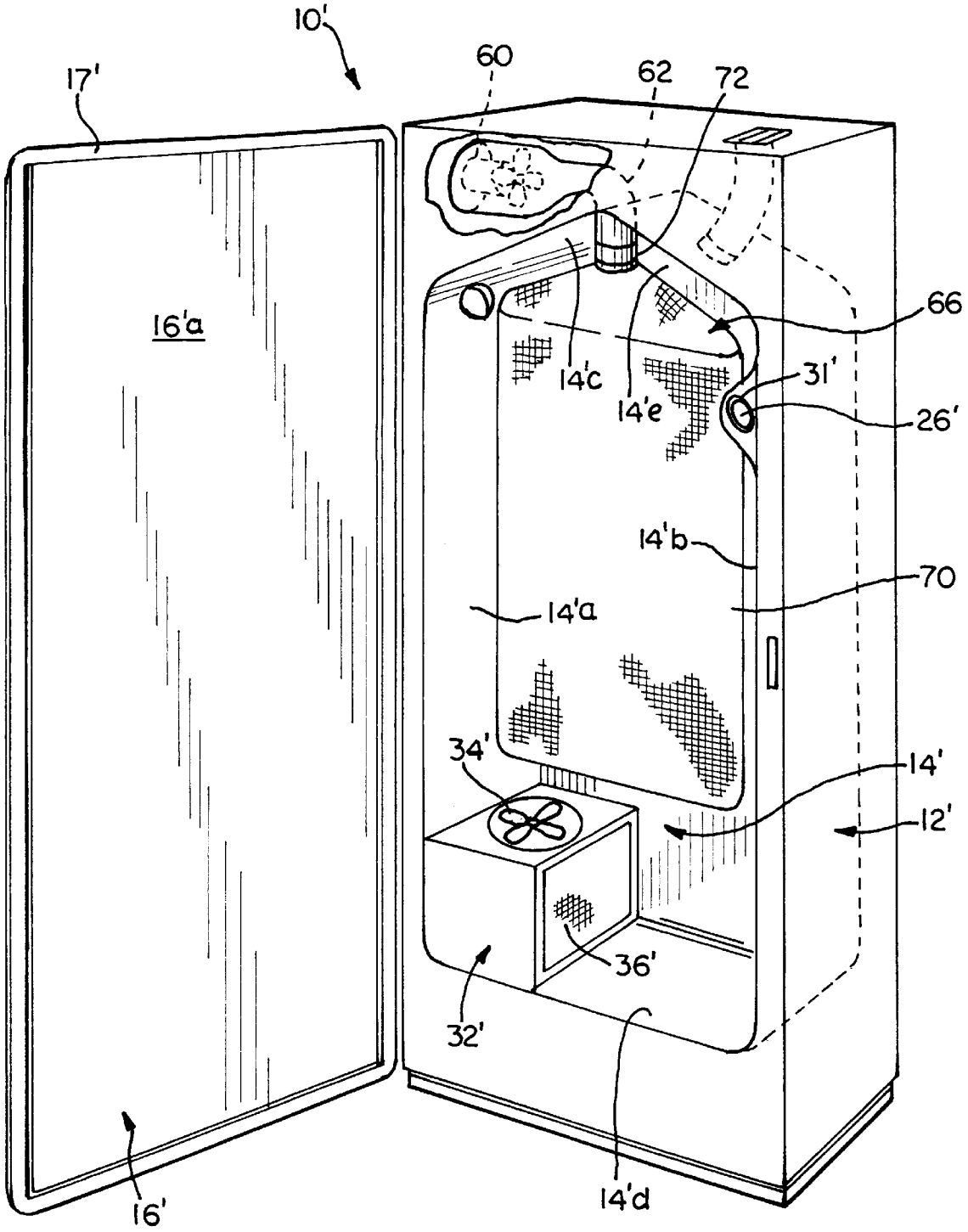
FIG. 4 is a top, front perspective view of an alternate embodiment of the clothes treating cabinet of the present invention, shown with the front door open.

FIG. 4 illustrates an alternate embodiment of the present invention which includes, in addition to the conditioning composition dispensing system discussed above, means for pressing garments hanging within an apparatus 10'. To avoid unnecessary duplication, only the clothes pressing means are discussed with regard to the apparatus 10' but it should be kept in mind that the invention of FIG. 4 includes the elements disclosed in FIGS. 1–3, with the exception of the rod 18. In describing the alternate embodiment, elements which correspond to elements already described with regard to the first embodiment are identified using similar numbers combined with an apostrophe.

The clothes treating apparatus 10' includes a cabinet 12' which defines an interior region or enclosure 14' and further includes an upper housing 24'. The upper housing 24' supports a blower assembly 60 which is connected to an air supply duct 62. Alternatively, the blower may be housed in the base of the cabinet. The air supply duct 62 has an end 64 which extends through a top surface 14*c'* of the cabinet enclosure 14'. When energized, the blower 60 moves air through the duct 62 and out through the end 64.

An inflatable hanger assembly 66 including a rigid hanger body 68 and an inflatable bag 70 is supported within the cabinet interior region 14'. The hanger body 68 includes a tubular inlet end 72 and a hanger-like hollow body portion 74 which connects to the inflatable bag 70. The tubular inlet end 72 is configured to connect to the end 64 such that the blower 60 may blow air into the hanger assembly 66. The means by which the tubular inlet end connects to the connection end can be any quick-connect type system for sealingly connecting two tubular members.

The inflatable bag 70 is removably mounted to the hanger body 68. The advantage of having a removable bag lies in both maintenance and performance of the clothes treating apparatus. The removable mounting permits the bag to be replaced if it is somehow damaged as well as providing ease of access while dressing the bag with a garment. This is especially important for pull over type garments which do not have zippered or buttoned fasteners. Also, different bag sizes and configurations may be needed depending on the size and type of clothing being treated.

Once mounted and sealed to the hanger body 68, air supplied to the hanger body 68 inflates the inflatable bag 70. When the inflatable bag 70 is inflated and the door 16' is closed, the side walls of the bag 70 press against rear wall 14*e'* and the inner surface 16*a'* of the door 16'. In this manner, when the bag is inflated, any shirt-like garment placed about the inflatable bag 70 is pressed to remove wrinkles. The pressure applied to the clothes can be designed, by appropriately sizing the blower 20, to optimize dewrinkling clothes. In some cases (dewrinkling delicate clothes), less dewrinkling pressure may be desired. Where less dewrinkling pressure is desired, the inflatable bag 70 may be replaced with a perforated bag which, due to the perforations, applies less pressure to clothes item placed about the inflatable bag. The blower 60 may also be of a variable speed type such that variable dewrinkling pressure may be obtained by varying the blower speed. Alternatively, a fixed speed blower can provide variable speeds by using a flow restricter actuated either mechanically or electrically.

It can be seen, therefore, that the present invention provides a unique clothes treatment cabinet which effectively refreshes garments by applying a conditioning composition onto the garments without requiring the application of steam. Although the present invention has been described with reference to a specific embodiment, those of skill in the Art will recognize that changes may be made thereto without departing from the scope and spirit of the invention as set forth in the appended claims.

We claim:

1. A clothes treating apparatus for treating a garment comprising:

a cabinet defining an interior region for receiving clothes;

a door movably connected to the cabinet;

a hanger for supporting the garment within the interior region;

a fan for circulating air within the interior region;

a nozzle supported by the cabinet;

a reservoir containing a conditioning composition, the reservoir fluidly connected to the nozzle; and an air compressor connected to the nozzle for supplying air to the nozzle such that air combines with conditioning composition from the reservoir which is sprayed from the nozzle to form a mist which is supplied into the interior region, wherein the cabinet includes a side wall having a cavity and the reservoir is supported in the cavity formed into the side wall of the cabinet.

2. A clothes treating apparatus for treating a garment comprising:

a cabinet defining an interior region for receiving clothes;

a door movably connected to the cabinet;

a hanger for supporting the garment within the interior region;

a fan for circulating air within the interior region;

a nozzle supported by the cabinet;

a reservoir containing a conditioning composition, the reservoir fluidly connected to the nozzle;

an air compressor connected to the nozzle for supplying air to the nozzle such that air combines with conditioning composition from the reservoir which is sprayed from the nozzle to form a mist which is supplied into the interior region; and a supply tube extending from the reservoir to the nozzle, the supply tube being removably connected to the reservoir, wherein the reservoir is removably supported by the cabinet such that the reservoir can be readily removed from the cabinet and refilled with conditioning composition.

3. A clothes treating apparatus for treating a garment comprising:

a cabinet defining an interior region for receiving clothes;

a door movably connected to the cabinet;

a hanger for supporting the garment within the interior region;

a fan for circulating air within the interior region;

a nozzle supported by the cabinet;

a reservoir containing a conditioning composition, the reservoir fluidly connected to the nozzle;

an air compressor connected to the nozzle for supplying air to the nozzle such that air combines with conditioning composition from the reservoir which is sprayed from the nozzle to form a mist which is supplied into the interior region; and a deceleration region provided within the interior region above the supported garment adjacent the nozzle for allowing the mist sprayed from the nozzle to slow down and recirculate within the interior region.

4. A clothes treating apparatus comprising:

a cabinet defining an interior region for receiving clothes;

a door movably connected to the cabinet;

a hanger for supporting a garment within the interior region;

a nozzle supported by the cabinet, the nozzle having a fluid passage having an outlet orifice and an air passage;

a reservoir containing a conditioning composition, the reservoir being supported by the cabinet below the nozzle and being fluidly connected to the fluid passage within the nozzle; and an air compressor connected to the air passage of the nozzle for supplying air to the nozzle such that an air stream flows over the outlet orifice of the fluid passage and draws conditioning composition from the reservoir which is mixed with the air stream to form a mist which is supplied into the interior region, wherein conditioning composition is mixed with an air flow for forming a mist which is dispensed from the nozzle without requiring a valve between the reservoir and nozzle.

5. The clothes treating apparatus according to claim 4 wherein the interior region has opposed inner side surfaces, the clothes treating apparatus further comprising:

an inflatable bag associated with the hanger wherein the garment can be disposed about the inflatable bag; and a blower supported by the cabinet for inflating the inflatable bag to press the garment against the opposed inner side surfaces of the interior region.

6. The clothes treating apparatus according to claim 4 wherein the cabinet includes side walls, at least one of the side walls having a cavity in which the reservoir is slidingly received.

7. The clothes treating apparatus according to claim 6 further comprising:

a supply tube extending from the reservoir to the nozzle, the supply tube removably connecting to the reservoir, wherein the reservoir is removably supported with the cavity formed in the side wall of the cabinet such that the reservoir can be readily removed from the cabinet and refilled with conditioning composition.

8. The clothes treating apparatus according to claim 4, the clothes treating apparatus further comprising:

a deceleration region within the interior region such that mist sprayed from the nozzle is allowed to slow down and recirculate within the interior region.

9. The clothes treatment apparatus according to claim 4 wherein the interior region forms a cavity having internally radiused corners to promote air recirculation within the interior region.

* * * * *